US006807501B1

(12) United States Patent
Hyde

(10) Patent No.: US 6,807,501 B1
(45) Date of Patent: Oct. 19, 2004

(54) DYNAMIC RELATIVE LOAD RATE FOR FLUID SYSTEMS

(76) Inventor: Thomas Allen Hyde, 1607 N. H St., Midland, TX (US) 79701-4031

( * ) Notice: Subject to any disclaimer, the term of this patent is extended or adjusted under 35 U.S.C. 154(b) by 0 days.

(21) Appl. No.: 10/335,117

(22) Filed: Dec. 30, 2002

Related U.S. Application Data

(60) Provisional application No. 60/346,243, filed on Dec. 31, 2001.

(51) Int. Cl.[7] ..... G01L 25/00

(52) U.S. Cl. ..... 702/114; 700/28; 73/53.01; 702/13

(58) Field of Search ..... 700/28; 73/53.01, 73/168; 702/189, 9, 13, 114; 166/374; 137/155

(56) References Cited

U.S. PATENT DOCUMENTS 6,070,608 A * 6/2000 Pringle ..... 137/155
6,227,302 B1 * 5/2001 Pringle et al. ..... 166/374
6,591,201 B1 7/2003 Hyde

OTHER PUBLICATIONS

API 11V2 Work Group: Gas–lift Valve Performance Testing Proposed draft for Section 1.0 of 11V2 Jan. 13, 1992 [Copy Attached].

Report for API 11V2 RP Verification Tests. Part II –Gas–lift Valve Probe Test by Laio, Tianlu, May 10, 1993 [Actual tests conducted toverify procedures –Copy Attached].

Gas–lift Valve Performance Testing, API Recommended Practice 11V2 Second Edition– Mar. 2001 [This document is substantially the same as the 1992 document in Sections 4 and 5. A request has been sent to the American Petroleum Institute, 1250 L Street NW, Washington, D. C. 20005 4070 tel. 202 682 8000, to permit a copy of Sections 4 and 5 to be forwarded to the USPTO.].

U.S. patent application Ser. No. 10/259,970, Hyde, filed Sep. 27, 2002.

U.S. patent application Ser. No. 09/936,608, Hyde, not published.

U.S. patent application Ser. No. 10/259,970, Hyde, not published.

Excerpt: Kermit E. Brown, Gas Lift Theory and Practice The Pertroleum PUblishing Co., Tulsa, OK, 1967 Chapters 8,11, 13, and 14. [Included for reference].

[Reference] Harold W. Winkler, Gas Lift Manual, 6th printing, 1962.

McMurry Oiltools, Inc,"Gas Lift Troubleshooting Procedures"[Not dated] [Reference included].

Oil World "Troubleshooting gas lift wells", Engineering Practices Manual No. 7 [Reference, not dated] Author: J. W. Montgomery [Reference included].

Excerpt: Kermit E. Brown, *The Technology of Artificial Lift*, Petroleum Publishing Co., Tulsa, OK,1980, [Sections 3.41, 3.4261, 3.4262, 3.4263 included for Reference].

These references are included here to demonstrate that existing art does not reference dynamic relative loading in gas lift operations.

Gas–life Valve Performance Testing [API Recommended Practice 11V2 Second Edition, Mar. 2001] Aremican Petroleum Institute, 1220 L Street, NW, Washington,D. C.

* cited by examiner

*Primary Examiner*—Kamini Shah

(57) ABSTRACT

Loading of one fluid control device with respect to other fluid control devices in a fluid system is evaluated by a Dynamic Relative Load Rate [DRLR] variable that is common to each devices. DRLR methods compare the relative performances of multiple fluid control devices, such as strings of gas-lift valves that lift hydrocarbons in a well-field. The dimensions of a DRLR variable are a combination of the dimensions of fluid pressure, flow rate, temperature, mass, length, and/or time test data. Evaluating graphs of DRLR data shows that the conventional measure of a gas-lift-valve-bellows load rate, kPa/cm (psi/inch) is only one member of a set of relative load-performance measures, including kPa/sec (psi/sec), that describe the loading-sensitivity of fluid control devices. Test data are generated quickly and cost effectively by a Fluid Energy Pulse Test System with improvements.

20 Claims, 5 Drawing Sheets

| FIG. # | Opening Pressure [A] | Operating Pressure [B] | Closing Pressure [C] | [A] - [B] | [B] - [C] |
|---|---|---|---|---|---|
| 1 | 870 | 805 | 755 | 65 | 50 |
| 2 | 840 | 780 | 740 | 60 | 40 |
| 3 | 780 | 730 | 690 | 50 | 50 |
| 4 | 750 | 705 | 655 | 45 | 50 |
| 5 | 690 | 650 | 610 | 40 | 40 |
| 6 | 625 | 595 | 550 | 30 | 55 |
| 7 | 540 | 520 | 475 | 20 | 45 |
| 8 | 305 | 300 | 250 | 5 | 50 |

DYNAMIC RELATIVE LOAD RATE FOR FLUID SYSTEMS

CROSS REFERENCE TO RELATED APPLICATIONS

Dynamic Relative Load Rate For Fluid systems, Provisional Patent Application No. 60/346,243, dated Dec. 31, 2001

Fluid Energy Pulse Test System, U.S. Pat. No. 6,591,201 dated Jul. 8, 2003 application Ser. No. 09/963,608, dated Sep. 25, 2001 with priority date Sep. 28, 2000

Fluid Energy Pulse Test System—Transient, Ramp, Steady State, application Ser. No. 10/258,970, dated Sep. 27, 2002 with priority date Sep. 27, 2001

REFERENCE TO FEDERALLY SPONSORED RESEARCH

Not applicable

REFERENCE TO A COMPUTER PROGRAM LISTING APPENDIX

Not applicable

FIELD OF INVENTION

The invention disclosed relates to dynamic load-rate relationships for individual, as well as for multiple fluid control devices that operate as a fluid sub-system or larger fluid system, such as pressure sensitive gas-lift valves used in the production of hydrocarbons, and more specifically to methods that describe, compare, and contrast the dynamic loading characteristics of these devices to improve the operation of such fluid systems and to ensure that such fluid systems are appropriately designed.

BACKGROUND OF THE INVENTION

Approximately 10% of the daily world oil production is generated by pressure sensitive gas-lift valves in approximately 60,000 wells worldwide. Gas-lift valves are also used to unload fluids that accumulate in new and existing wells in order to start oil and gas wells flowing and to increase the production of oil and gas. In addition, gas-lift valves are used to assist in the disposal of waste fluids in fluid disposal wells.

Technology to produce fluid from wells by air-lift or gas-lift has been available to the petroleum industry for more than one hundred years. From the inception of air-lift or gas-lift valve use, testing and evaluating these valves has been a complex and costly process. Current Art describing gas-lift valve systems to produce hydrocarbons usually requires more than one gas-lift valve for a single well. Multiple gas-lift valves, for example, ten valves, may be needed to produce hydrocarbons from a specific underground formation. These fluid control devices deteriorate during their use as a result of many environmental and operating conditions into which the valves are placed.

U.S. Pat. No. 6,591,201 (Hyde) dated Aug. 7, 2003. Fluid Energy Pulse Test System [FEPTS] describes new equipment and methods to evaluate efficiently the performance of fluid control devices, such as gas-lift valves, by short duration energy pulses. The FEPTS technology describes test chambers and related fluid systems, and computer automated methods that can determine valve dynamic characteristics, including, opening pressure, closing pressure, flow rate, valve flutter, bellows characteristics, and leaking components. Patent application Ser. No. 10/259,970 (Hyde), Fluid Energy Pulse Test System—Transient, Ramp, Steady State [FEPTS—TRS] describes improvements to the FEPTS apparatus and methods to generate temperature-controlled and acoustically monitored transient, ramp, constant-steady-state, and periodic-steady-state test data by explosive regulation of fluid pressure and fluid flow rate for fluid control devices under test.

U.S. Pat. No. 6,591,201 and patent application Ser. No. 10/259,970 in their entirety, are incorporated herein by reference, and are referred to collectively as FEPTS. The Art described by these inventions teaches how to generate test data for fluid control devices such as individual gas-lift valves that are commonly described as tubing retrievable [TR] or wireline retrievable [WR] injection pressure operated gas-lift valves [IPO-GLVs] or production pressure operated gas-lift valves [PPO-GLVs]. The circular dimensions of pressure sensitive fluid control gas-lift valves of varying lengths are standardized by industry with outside diameters of 1.5875 centimeters (five-eighths inches), 2.54 centimeters (one inch), and 3.81 centimeters (one and one-half inches).

When a well is to be operated by gas-lift valve technology, each individual valve in a string of valves must be sized to pass a required amount of fluid through the valve. Gas-lift valve strings lift fluid in wells either intermittently or continuously, depending upon the fluid producing formation properties. Sizing a gas-lift valve includes determining a port size, opening pressure, closing pressure, fluid flow rate, and valve load rate. Each gas-lift valve is placed in a well to perform its function of assisting in the lift of the well's economic fluid.

With current Art, when each valve in a gas-lift valve string is sized to conform to a gas-lift valve lifting design scheme, the resulting system may function excellently, moderately, poorly, or not at all. Inadequate or sub-optimal operation is a result of the current inability to compare and contrast the operation of individual valves in a string of valves before they are placed into a well. It is common practice in the petroleum industry to over design gas-lift valve strings so that some fluid will flow. As much as 200% error in the design of lifting parameters can occur. Common practice and economics dictate that if a gas-lift well is flowing, gas-lift valve parameters are not changed even if the lifting program is substantially sub-optimal. The principal gas-lift valve parameter that specifies how a gas-lift valve will function to open, close, and pass fluid is called the valve load rate.

The load rate of a gas-lift valve is determined by procedures described in the American Petroleum Institute Recommended Practice for Testing Gas-Lift Valves, 1995 and API Recommended Practice 11V2, Second Edition, March 2001. A gas-lift valve is subjected to small changes in pressure as the distance of valve-stem travel is measured. Stem travel from fully closed to fully open is commonly in the range from zero to 0.254 centimeters (0.100 inches) or zero to 0.508 centimeters (0.200 inches). By changing pressure, a graph of valve-stem travel with respect to pressure can be generated. This graph commonly shows a linear characteristic with dimensions of kPa per centimeter (psig per inch). When valve-stem travel is measured by increasing then decreasing pressure, a hysteresis effect occurs. The increasing and decreasing pressure paths of valve-stem travel with respect to pressure are averaged to generate a numerical load rate, for example, 1397 kPa/centimeter (500 psig/inch).

The evaluation of a gas-lift valve load rate is time consuming, requires some valve disassembly and special equipment to monitor stem travel, and applies only to the specific gas-lift valve evaluated. The gas-lift valve load rate data are extrapolated to include all gas-lift valves manufactured to the same specification under various pressure conditions. Thus a benchmark criterion is generated to create a valve load rate.

A gas-lift valve's load rate is closely related to the valve's parameter settings for opening pressure, operating pressure, closing pressure, and fluid flow rate. When a gas-lift valve is configured for a gas-lift valve string, the common practice is to set the valve's bellows-dome pressure, the valve's-spring compression, or where applicable, a combination of dome pressure and spring compression. The load rate test is a static test and the petroleum industry has standardized load rate test criteria. For nitrogen charged valves, the nitrogen dome is charged to a pressure of 5617.1 kPa (800 psig), 8274 kPa (1200 psig) and in a separate test, to the manufacturer's maximum charge pressure. All pressures are referenced to 15.56 degrees Celsius (60 degrees Fahrenheit). For spring loaded valves, the spring compression is set to provide the manufacturer's maximum recommend set pressure. Specialized equipment requiring some valve disassembly is used to measure stem travel with a micrometer probe. Data are taken at different pressures and a load rate for the gas-lift valve is obtained by averaging the test results. A single numerical load rate value for a valve is generated in units of kPa per centimeter (psig per inch).

Each valve in a string, manufactured under the same specifications, is assumed to follow the load rate data generated by a benchmark load rate test. Gas-lift valve strings with multiple valves are then designed by selecting a gas-lift valve with a specific port size and setting each individual valve in a string to its design opening pressure. These static activities do not provide any information about how a gas-lift valve functions dynamically in the system of gas-lift valves designed to lift fluids. There are no dynamic properties available that are associated with the individual valves or with a string of valves.

In practice, current Art to improve hydrocarbon production by gas-lift involves addressing many well-field activities. Studies to improve well-field operations commonly assume that the gas-lift valves strings are working properly. For example, for well-fields, two types of techniques are used to analyze gas-lift installations. These techniques are named the detailed methods and the observation methods. Detailed methods include acquiring flowing pressure surveys, flowing temperature surveys, fluid level soundings, and surface casing and tubing pressure variations. Observation methods include monitoring surface back pressures, total fluid recovery, injection gas volumes, total produced gas volumes, operating injection pressures, and temperatures of flow lines. However, a generally accepted petroleum industry practice in operating gas-lift well-fields is to wait until trouble occurs before analyzing the gas-lift installation, which leads to the problem that without prior knowledge of the dynamic characteristics of each gas-lift well, changing the design of one or more wells involves guesswork.

As a result, the current Art suffers from a number of disadvantages.

(a) There are no efficient, cost effective methods to compare static and dynamic operating characteristics of individual gas-lift valves that function within a string of gas-lift valves.

(b) Current technology does not address the dynamic load rate of valves that are set to practical operating pressures which may be any pressure in a practical range from a few hundred kPa (psig) to 10,443 kPa (1500 psig) or more.

(c) Current Art acquires only static load rate data, which data do not provide information on fluid pressure and fluid flow rate dynamic loading effects.

(d) Load rates and load rate testing are not an integral part of the gas-lift valve string design because dynamic load rate data are hidden by simple approximations and assumptions about valve operation.

(e) The time required and equipment used to conduct a static load rate test make it impractical and costly to determine the load rate for each individual valve.

(f) There are no methods available to determine the dynamic operating properties of one valve relative to the other valves in a string.

(g) Gas-lift valve strings are known to operate in well-fields as a system of components that must function in relative relationship from one component to another but engineering designs do not expressly address the valve strings as a system because there are no practical methods available to demonstrate the relative operating relationships of one valve relative to the other valves, or one string of valves relative to other strings.

SUMMARY OF THE INVENTION

In accordance with the principles of the disclosed invention herein designated Dynamic Relative Load Rate [DRLR] For Fluid Systems, there are provided:

(a) methods to acquire DRLR test data for gas-lift valves from tests that are conducted with FEPTS equipment and techniques;

(b) techniques to evaluate FEPTS test data on valve opening pressure, closing pressure, fluid flow rate, and differential pressure rates to establish relative dynamic operating characteristics of one valve with respect to other valves in a string of valves;

(c) ways to include gas-lift valve relative dynamic load rate data in the engineering design of valve strings to improve the economic cost in operating gas-lift valve strings to lift fluids;

(d) methods to use gas-lift valve operating data to demonstrate how a valve string will function when compressor driving pressures, or field gas pressures are increased or decreased from the design driving pressure, or are subject to transient drive pressure conditions;

(e) methods to determine the value of a DRLR variable of a gas-lift valve for any pressure within the range of a few hundred kPa (psig) to 10,443 kPa (1500 psig) or to the manufacturer's maximum operating pressure;

(f) methods to identify a failing or faulty gas-lift valve which may pass all standard tests such as tests for leaks, opening pressure, closing pressure, and fluid flow rate but which valve's performance, relative to the other valves in a string of valves, is unsatisfactory; and, (g) methods to identify the operating characteristics of a string of gas-lift valves relative to other strings of gas-lift valves used to produce hydrocarbons from a well-field by the direct transfer of DRLR methods to describe the loading of a string of gas-lift valves relative to other strings of gas-lift valves in a well-field.

The FEPTS describes equipment and methods to acquire and to evaluate the performance characteristic curves and operating properties of fluid control devices, including gas-lift valves. Various kinds of data are acquired by the FEPTS to evaluate the operating characteristics of individual fluid control devices such as gas-lift valves.

The invention of DRLR For Fluid Systems uses test data acquired from single or from multiple fluid control devices to determine the relative loading of a fluid control device when subjected to different operating conditions. In gas-lift valve strings, multiple gas-lift valves are used to lift fluids from operating wells. It is practical to compare and contrast the operating properties of individual fluid components, such as gas-lift valves, because the FEPTS generates appropriate comparison and contrast data quickly and economically.

As a result of the ease of operation and fast response time generated by the FEPTS, there are several methods to compare the operating characteristics of multiple fluid control devices that function as a system. Gas-lift valves that are used in hydrocarbon production are illustrated here, by example, to describe the principles upon which the comparisons and contrasts of fluid control devices are made by following methods described by the present invention of DRLR For Fluid Systems.

DRLR characteristics for individual gas-lift valves in a string of gas-lift valves operating as a system are generated from valve operating properties available from FEPTS valve performance test data. For example, properties available for DRLR comparison include: opening pressure, operating pressure, closing pressure, flow rate at various pressures, pressure rate increase or decrease across a valve port, and time of a performance event. With FEPTS equipment, test data can be obtained for open-to-the-atmosphere, partly-open-to-the-atmosphere, or closed-to-the-atmosphere test conditions. A DRLR variable for a specific fluid component in a system is defined as a ratio of operating parameters. This DRLR ratio is made up of a numerator and a denominator term. The numerator and denominator terms may be both static, both dynamic, or one static and one dynamic. Because the DRLR concept is relative loading, dynamic relative load rates with dimensions other than kPa per centimeter (psig per inch) of stem travel can be used to provide information about how a fluid component functions dynamically in relationship to other fluid components. The conventional load rate dimensions of kPa per centimeter (psig per inch) is simply one member of a much larger set of dimensions that define load sensitivity and that describe how a fluid control device, such as a gas-lift valve, functions under different loading conditions.

Formally, DRLR ratios, alternatively DRLR variables, are generated from a static numerator and a static denominator; a dynamic numerator and a static denominator; a static numerator and a dynamic denominator, and/or a dynamic numerator and a dynamic denominator. If static variables are used for both the numerator and denominator in the ratio, and are constant, the static term will be the same value for each same-component in a system. [The term "same-component" means that each fluid component is manufactured to the same specification.] If a static variable is generated to approximate the load on a device from information acquired by conventional testing, a linear or other path relationship of mechanical motion can be used for a range of test pressures to provide relative loading information. Thus, DRLR ratios can be generated with a linear or other path approximation of mechanical stem travel. For different-components, the static term can be a different value for each different-component in the fluid system.

When a DRLR ratio contains two constant static terms for same-components, no information is provided about how one component functions in comparison to other components in a system.

A DRLR ratio comprising one static term and one dynamic term, provides a first method to compare the operation of individual fluid components, one relative to another, in a system of fluid components. For illustration, a static term is placed in the denominator. For same-components, the static term may be the same for each component or the static term may be a linear or other path approximation of stem travel. The numerator term then is used to evaluate the relative performance due to loading on individual fluid components. For individual components in a system to function as an operating system, the DRLR ratios will have a particular characteristic trend, which depends upon the physical properties and construction of the components. The trend may exhibit constant, linear, exponential, frequency, or other characteristics that describe the system operation by the relative comparison of how each individual component functions when working with the other components in the system. The static term will be either constant or a specific approximation of stem travel, such as a linear approximation. A relative comparison of the operation of the system is generated by the influence of the numerator term of the ratio. This approach permits normalizing dynamic load rate data so that the DRLR variables for components in the system can be compared to unity at a particular operating point of the system. In this way, groups of components can be evaluated as a system.

One example of a DRLR comparison scheme, among many DRLR comparisons schemes for gas-lift valves in a string of valves, can be created with one static value and one dynamic value. Steps to generate a DRLR variable from energy pulse test data are:

[1] select a static or dynamic denominator term that will be combined with the numerator term from one or more operating variables that describe loading, alternatively, the operating characteristics of the fluid component; if appropriate, use mathematical operations to generate one value for the denominator term;

[2] select a numerator term that will be combined with the denominator term from one or more operating variables, which describe the loading, alternatively, the operating characteristics of the fluid component; if appropriate, use mathematical operations to generate one value for the numerator term;

[3] normalize the result if appropriate; and,

[4] Choose an appropriate variable for the abscissa of a DRLR graph and plot the DRLR characteristic curve.

For example, a constant static denominator value of 0.508 centimeters (0.200 inches) may be used to define maximum valve stem travel for each valve manufactured to the same specification in a string of valves. The static denominator might be assumed to be the same for each valve. In this example, the dynamic numerator might be selected to be the difference between the opening pressure and the operating pressure of the gas lift valve. The opening and operating pressures for this comparison scheme could be derived from a closed-to-the atmosphere, open-to-the-atmosphere, or partly-open-to-the-atmosphere test procedure as described by the FEPTS.

Comparisons of the DRLR variables of the nonlinear pressure sensitive gas-lift valves are sensitive to changes in operating conditions. The initial conditions used to determine the value of each DRLR variable must be consistent; otherwise, the relative relationships among individual gas-lift valves manufactured to the same specifications cannot be assured. For example, in identifying each DRLR variable with a specific operating pressure, a comparison of four gas-lift valves with DRLR values determined from opening pressure, operating pressure, and constant stem travel of 0.508 centimeters (0.200 inches) could generate the two-tupples: [1397.1 kPa/cm, at 5617.1 kPa (500 psig/inch, at 800 psig)], [1261.4 kPa/cm, at 5272.4 (450 psig/inch, at 750 psig)], [1125.7 kPa/cm, at 4927.6 kPa (400 psig/inch, at 700 psig)], and [990 kPa/cm, at 4582.9 kPa (350 psig/inch, at 650 psig)]. These example data clearly demonstrate a linear trend. If one of the gas-lift valves is not operating correctly or if its initial conditions for evaluation are not consistent with all evaluations, the DRLR trend will not be linear because the datum for such a valve will not have an appropriate relative position, or location, among the data. This simple example illustrates one possible DRLR comparison scheme among many DRLR comparison schemes. The trend, or scatter, of DRLR data will depend upon the settings, sizing, and operating characteristics of the type of fluid device or component under comparison. Other examples of DRLR comparisons of several gas-lift valves are illustrated in the drawings.

A DRLR ratio comprising two dynamic terms provides a second method to compare the operation of individual fluid components, one relative to others. The steps to generate DRLR data with two dynamic terms from FEPTS energy pulse test data are the same as steps [1], [2], [3], and [4] described above.

DRLR ratios can be characterized for gas-lift valve strings to ensure that individual valves function appropriately as a system. DRLR comparisons based upon individual valve dynamic operating properties can be incorporated into the design of a lifting scheme and can generate new valve-string parameters to be followed when installing valve strings. When DRLR comparisons are consistent, the valve string designer can be sure that the individual valves will operate as the system is designed to operate, even with changes, within limits, in driving fluid pressure for the system.

As a result of DRLR evaluations, the economic payback for fluid control systems such as gas-lift valve strings can be improved by generating data that show how each valve will operate, relative to the other valves, within the design parameters of a string of valves, even when drive pressures are not consistent. Moreover, the DRLR invention couples test operations of a gas-lift valve to actual operating conditions in the range from a few hundred kPa (psig) to the manufacturer's maximum operating pressure. Faulty gas-lift valves operating in a dynamic environment are identified by dynamic operating data generated from the DRLR invention. Clearly, the invention of DRLR For Fluid Systems is dependent upon methods to test and to generate fluid control device test data quickly and cost effectively. These criteria are met by the FEPTS.

Accordingly, objects and advantages of the DRLR invention are:

[1] to provide efficient, cost effective, methods to compare and contrast the operation of individual fluid devices and components that function within a system of fluid devices and components, such as gas-lift valve strings;

[2] to provide methods that permit the load rates of fluid control devices, such as gas-lift valves, to be compared for any pressure within the range of a few hundred kPa [psig] to the manufacturer's maximum recommended pressure, and to provide methods for load rate evaluation for fluid devices and components operating in vacuum;

[3] to provide DRLR data that can be used to characterize a system of fluid control devices so that the operation of one fluid device in a system can be compared to other fluid devices functioning to establish a fluid flow;

[4] to provide methods to identify failing or failed fluid devices that may have passed standard types of tests that do not incorporate dynamic variations;

[5] to provide information about fluid devices operating as a system that can be incorporated into the engineering design of the system of components;

[6] to provide a method to show how a system of fluid devices will function when pressure and flow rate deviate from the system design pressure and flow rate;

[7] to provide an alternative method to conventional Art that uses choke valves and constant pre-set operating pressures for individual gas-lift valves to generate required flow rates, thereby creating an alternative design for gas-lift valve strings; and,

[8] to provide a method to compare, contrast, and correlate dynamic relative load rate characteristics of individual gas-lift wells in a well field so that the analysis of gas-lift well installations can be initiated while the field is being designed rather than waiting until the field is in production to initiate analysis.

Further objects and advantages of the present invention of DRLR For Fluid Systems are to provide an apparatus and methods that identify DRLR variables for fluid components in order to establish how multiple fluid components function together under both optimal design operating conditions and non-optimal operating conditions, determined by: generating graphical data of dynamic performance; acquiring dynamic relative load rate data using different fluid driving functions such as impulse, step, ramp, and frequency response functions; characterizing the relative loading of one component with respect to another; permitting evaluations within a short time; establishing the robustness of a fluid system; and, initiating new ways to define the relative dynamic properties of fluid control devices and components that function as a fluid system. Further objects and advantages will become apparent from consideration of the following descriptions and drawings.

BRIEF DESCRIPTION OF THE DRAWINGS

The DRLR For Fluid Systems invention, its principles of identification, and the methods to generate comparisons and contrasts of fluid devices and components, will be understood more fully from the description given below with reference to the detailed description of the preferred embodiment and accompanying drawings, in which like reference numerals identify like elements in different figures, and in which related figures and elements have the same number but different alphabetic suffixes.

DETAILED DESCRIPTION OF THE DRAWINGS OF THE INVENTION

Figure 1:
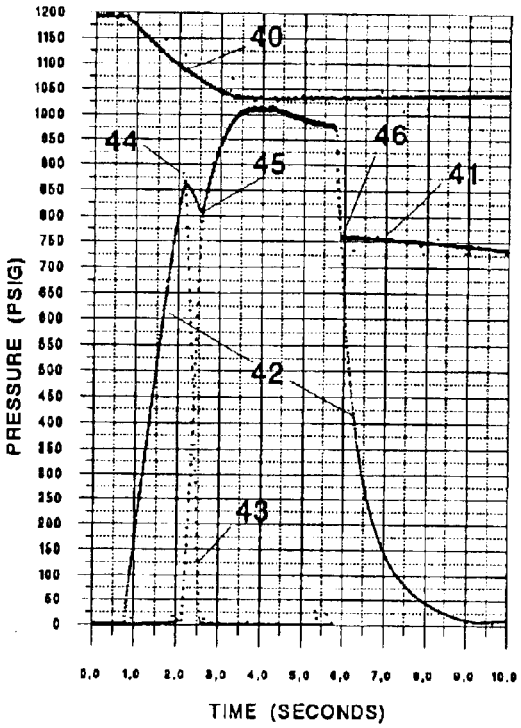
FIG. 1 shows opening pressure [6100 kPa (870 psig)], operating, and closing pressures for a gas-lift valve tested in closed-to-the-atmosphere conditions.

DRLR For Fluid Systems methods permit widely varying approaches to identify dynamic loading characteristics for individual fluid components functioning with other components in a fluid system. Neither the specific examples, nor the graphical renderings of data, as described herein, should be construed as limiting the presentation of DRLR data or the manner in which such data are generated from pressure and flow rate information acquired during the testing of individual fluid devices or components.

The detailed description of the drawings of the invention are intended to cover alternatives, modifications, and equivalents, as may be included within the spirit and scope of the DRLR methods, as defined by the appended claims.

The DRLR methods are described with respect to a preferred embodiment. This description is representative of many mathematical renderings of pressure and flow rate data and should be construed, not as limiting the scope of the DRLR For Fluid Systems invention, but as providing illustration of a presently preferred embodiment, the configuration of which is related to current practice of determining the static load rate for fluid components such as gas-lift valves. It is instructive to point out that load rate in kPa per centimeter or psig per inch is a limiting measure, that focuses upon mechanical movement within the fluid control device under the assumption that the mechanical movement is the only way to describe precisely how a fluid control device will operate. One of the reasons for this conventional Art approach is a focus of scientific methods and industry wisdom on the valve-mechanical motion.

The invention of DRLR For Fluid Systems accepts conventional mechanical motion as a given property of loading in fluid systems. The DRLR concept goes further in recognizing that the pressure and flow rate relationships generated by dynamic fluid driving forces, inherently include mechanical motion within fluid control devices. Thus, a wide variety of characteristics of loading a fluid control device can be observed and evaluated once the focus on kPa per centimeter or psig per inch parameters is changed to include the pressure and flow rate results generated by perturbation of the mechanical components of the fluid control device.

One reason that pressure and flow characteristics, associated with detailed information about opening pressure, operating pressure, closing pressure, and flow rate of fluid control devices, can be used to describe fluid device loading without requiring measurement of the mechanical components is the accuracy and precision of FEPTS data, which data have heretofore been impractical to acquire.

Three DRLR comparisons are generated from FIG. 1 through FIG. 8. These eight figures show data for a gas-lift valve that has been set for different opening pressures, which are accompanied by different operating pressures and different closing pressures. The operating points generated for the single valve described by FIG. 1 through FIG. 8 provide a model for a string of different gas-lift valves set to similar operating points. FIG. 1 through FIG. 8 establish criteria for each valve in a string of valves manufactured to the same specification to operate as a fluid system.

FIG. 1 data are referenced to an opening pressure 6100 kPa (870 psig). FIG. 1 shows upstream reservoir pressure [6100 kPa] 40, downstream valve pressure [6100 kPa] 41, upstream valve pressure [6100 kPa] 42, differential pressure [6100 kPa] 43, valve opening pressure [6100 kPa] 44, valve operating pressure [6100 kPa] 45, and valve closing pressure [6100 kPa] 46. These data are generated by a closed-to-the-atmosphere test as described by the FEPTS with a test protocol of slow positive [pressurizing] energy pulse generation to obtain opening and operating pressure data and slow negative [exhausting] energy pulse generation to obtain closing pressure data.

Figure 2:
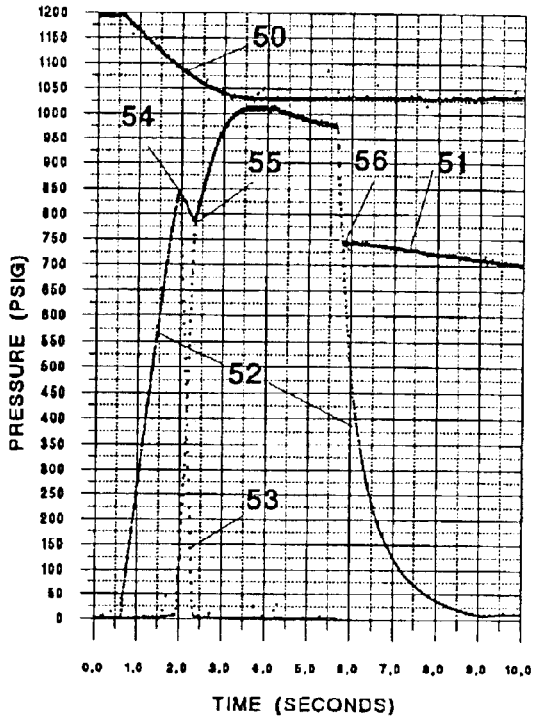
FIG. 2 shows opening pressure [5893 kPa (840 psig)], operating, and closing pressure for the same gas-lift valve of FIG. 1.

FIG. 2 data are referenced to an opening pressure 5893 kPa (840 psig). FIG. 2 shows upstream reservoir pressure [5893 kPa] 50, downstream valve pressure [5893 kPa] 51, upstream valve pressure [5893 kPa] 52, differential pressure [5893 kPa] 53, valve opening pressure [5893 kPa] 54, valve operating pressure [5893 kPa] 55, and valve closing pressure [5893 kPa] 56. FIG. 2 data are acquired by a protocol identical to the protocol used to acquire data for FIG. 1.

Figure 3:
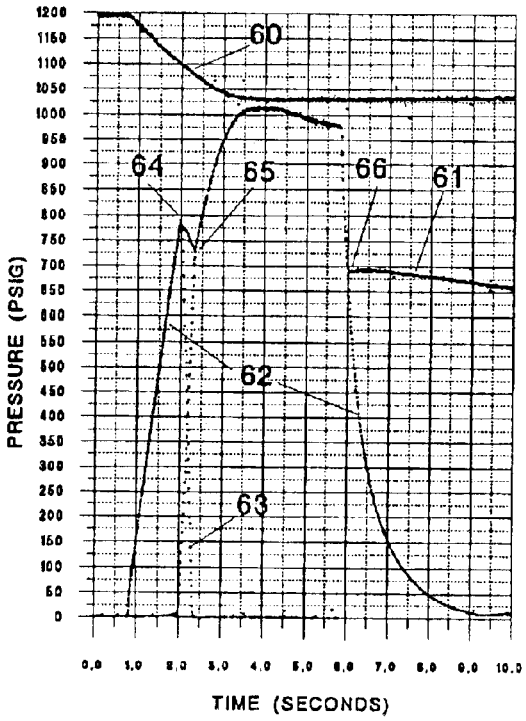
FIG. 3 shows opening pressure [5479 kPa (780 psig)], operating, and closing pressure for the same gas-lift valve of FIG. 1.

FIG. 3 data are referenced to an opening pressure 5479 kPa (780 psig). FIG. 3 shows upstream reservoir pressure [5479 kPa] 60, downstream valve pressure [5479 kPa] 61, upstream valve pressure [5479 kPa] 62, differential pressure [5479 kPa] 63, valve opening pressure [5479 kPa] 64, valve operating pressure [5479 kPa] 65, and valve closing pressure [5479 kPa] 66. FIG. 3 data are acquired by a protocol identical to the protocol used to acquire data for FIG. 1.

Figure 4:
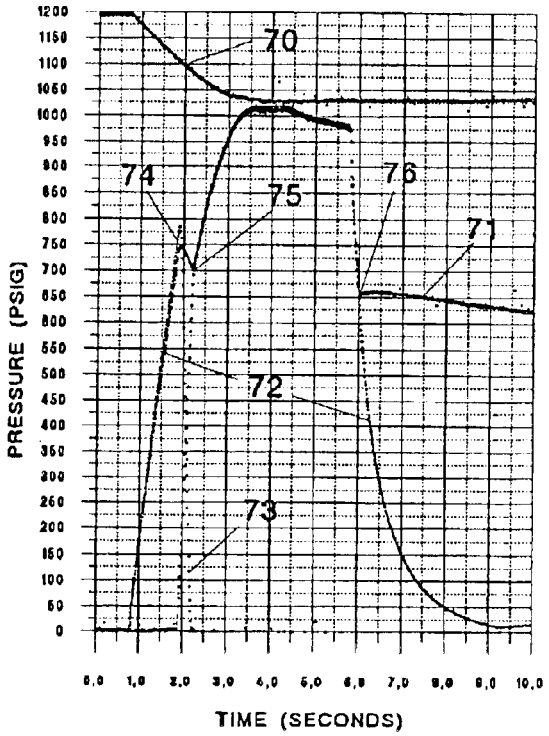
FIG. 4 shows opening pressure [5272 kPa (750 psig)], operating, and closing pressure for the same gas-lift valve of FIG. 1.

FIG. 4 data are referenced to an opening pressure 5272 kPa (750 psig). FIG. 4 shows upstream reservoir pressure [5272 kPa] 70, downstream valve pressure [5272 kPa] 71, upstream valve pressure [5272 kPa] 72, differential pressure [5272 kPa] 73, valve opening pressure [5272 kPa]. 74, valve operating pressure [5272 kPa] 75, and valve closing pressure [5272 kPa] 76. FIG. 4 data are acquired by a protocol identical to the protocol used to acquire data for FIG. 1.

Figure 5:
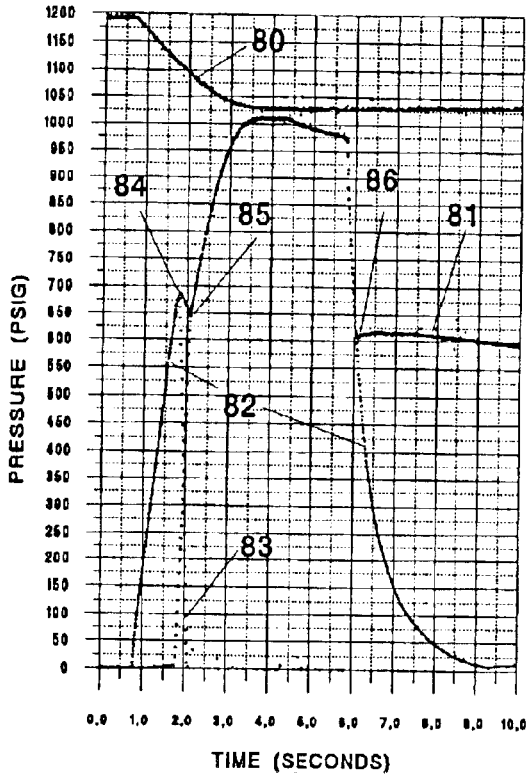
FIG. 5 shows opening pressure [4859 kPa (690 psig)], operating, and closing pressure for the same gas-lift valve of FIG. 1.

FIG. 5 data are referenced to an opening pressure 4859 kPa (690 psig). FIG. 5 shows upstream reservoir pressure [4859 kPa] 80, downstream valve pressure [4859 kPa] 81, upstream valve pressure [4859 kPa] 82, differential pressure [4859 kPa] 83, valve opening pressure [4859 kPa] 84, valve operating pressure [4859 kPa] 85, and valve closing pressure [4859 kPa] 86. FIG. 5 data are acquired by a protocol identical to the protocol used to acquire data for FIG. 1.

Figure 6:
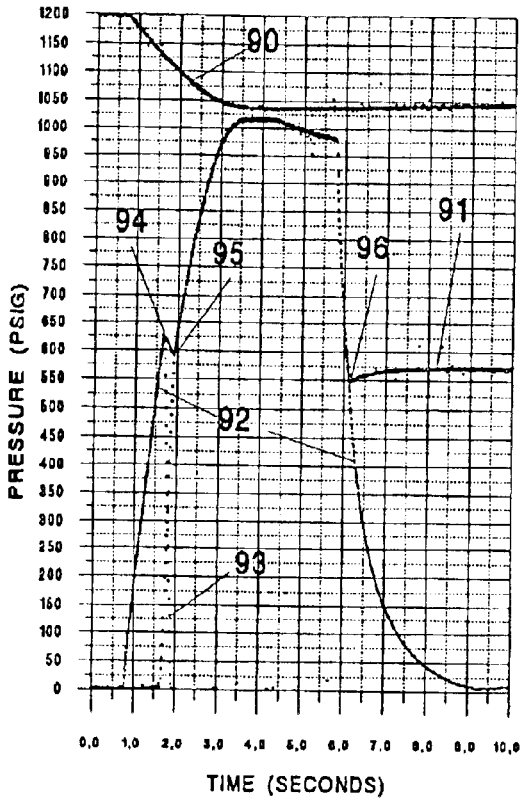
FIG. 6 shows opening pressure [4410 kPa (625 psig)], operating, and closing pressure for the same gas-lift valve of FIG. 1

FIG. 6 data are referenced to an opening pressure 4410 kPa (625 psig). FIG. 6 shows upstream reservoir pressure [4410 kPa] 90, downstream valve pressure [4410 kPa] 91, upstream valve pressure [4410 kPa] 92, differential pressure [4410 kPa] 93, valve opening pressure [4410 kPa] 94, valve operating pressure [4410 kPa] 95, and valve closing pressure [4410 kPa] 96. FIG. 6 data are acquired by a protocol identical to the protocol used to acquire data for FIG. 1.

Figure 7:
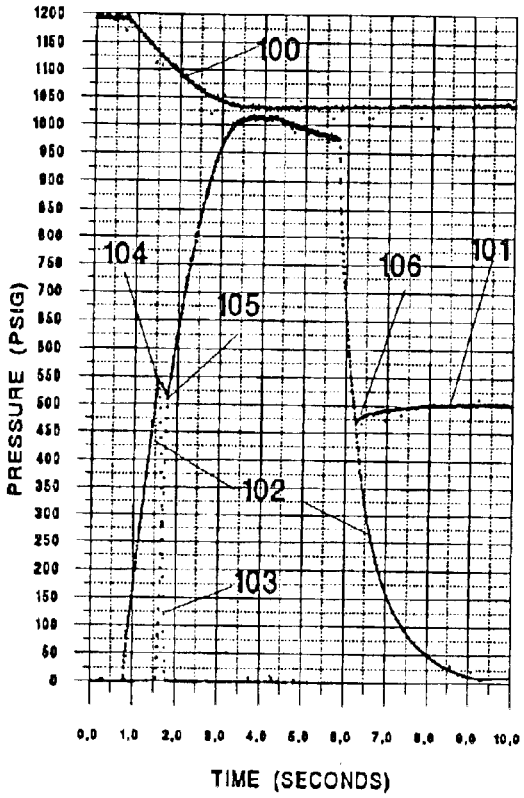
FIG. 7 shows opening pressure [3824 kPa (540 psig)], operating, and closing pressure for the same gas-lift valve of FIG. 1.

FIG. 7 data are referenced to an opening pressure 3824 kPa (540 psig). FIG. 7 shows upstream reservoir pressure [3824 kPa] 100, downstream valve pressure [3824 kPa] 101, upstream valve pressure [3824 kPa] 102, differential pressure [3824 kPa] 103, valve opening pressure [3824 kPa] 104, valve operating pressure [3824 kPa] 105, and valve closing pressure [3824 kPa] 106. FIG. 7 data are acquired by a protocol identical to the protocol used to acquire data for FIG. 1.

Figure 8:
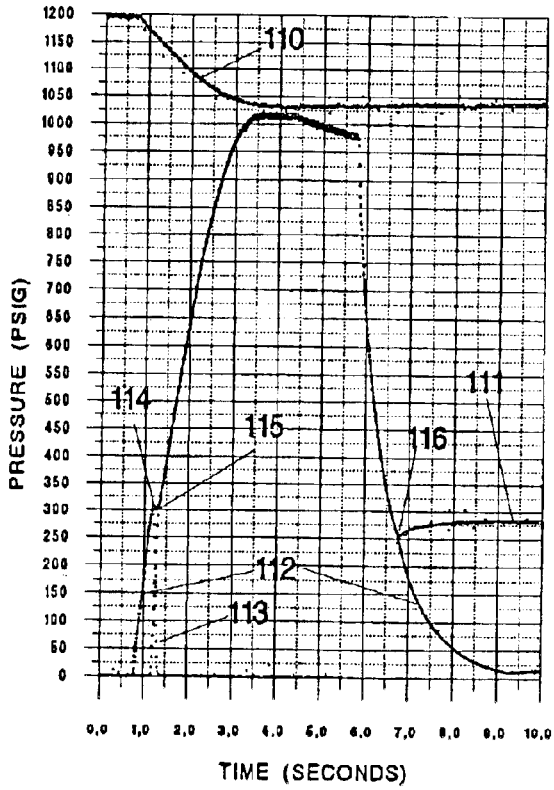
FIG. 8 shows opening pressure [2204 kPa (305 psig)], operating, and closing pressure for the same gas-lift valve of FIG. 1.

FIG. 8 data are referenced to an opening pressure 2204 kPa (305 psig). FIG. 8 shows upstream reservoir pressure [2204 kPa] 110, downstream valve pressure [2204 kPa] 111, upstream valve pressure [2204 kPa] 112, differential pressure [2204 kPa] 113, valve opening pressure [2204 kPa] 114, valve operating pressure [2204 kPa] 115, and valve closing pressure [2204 kPa] 116. FIG. 8 data are acquired by a protocol identical to the protocol used to acquire data for FIG. 1.

Figures 9, 10:
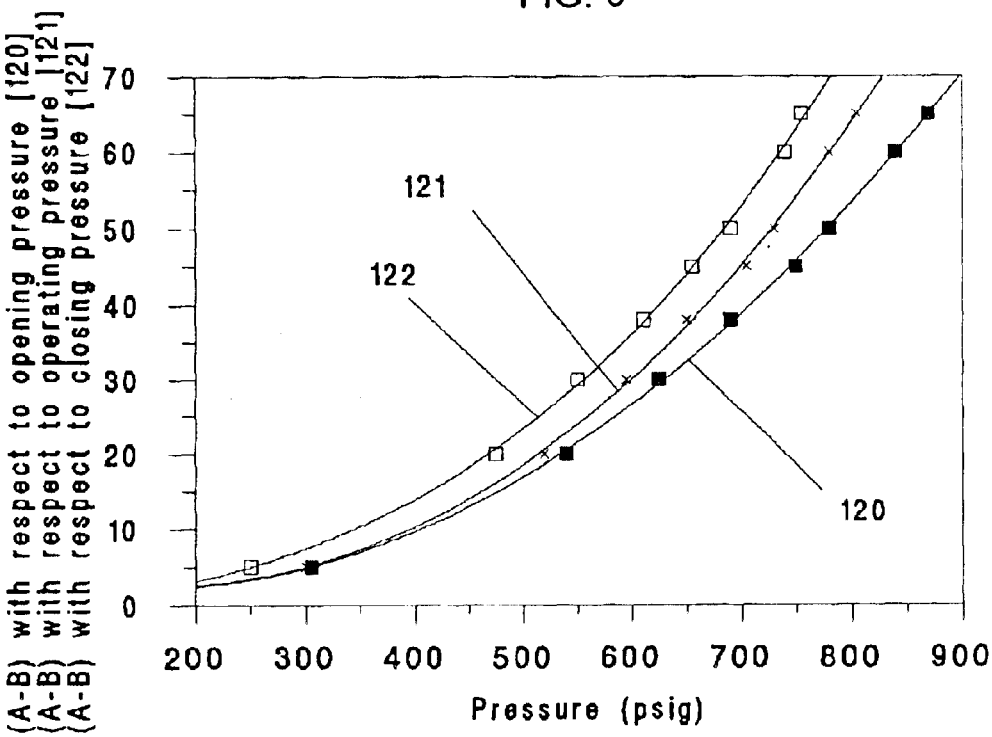
FIG. 9 shows a table of opening pressure, operating pressure, closing pressure, opening minus operating pressure, and opening minus closing pressure for FIG. 1 through FIG. 8.
FIG. 10 shows graphs of data related to the DRLR variables for the gas-lift valve of FIG. 1 describing opening pressure minus operating pressure plotted against opening pressure, operating pressure, and closing pressure as listed in FIG. 9.

FIG. 9 shows a table, in English units, of opening pressure [A], operating pressure [B], closing pressure [C], and subtractions [A]–[B] and [B]–[C] for FIG. 1 through FIG. 8. The data found in table of FIG. 9 are generated by enlarged renderings [not shown] of the test data of FIG. 1 through FIG. 8.

FIG. 10 shows DRLR curves for a single valve set to eight different operating points that is equivalent to a string of eight gas-lift valves, each set to a corresponding operating point. The single gas-lift valve is designated the reference valve for the string and can assume any one of the eight operating points. Gas-lift valves manufactured to the same specification as the reference valve and set to the individual operating points will be pressure loaded according to the reference valve operating points. The ordinate is defined as opening pressure minus operating pressure [ΔP]and the abscissa is defined as opening pressure [OPEN], operating pressure [OPER], or closing pressure [CP]. With ΔP defined as opening pressure minus operating pressure, path 120 is a parabolic trace with respect to opening pressure, path 121 is a parabolic trace with respect to operating pressure, and path 122 is a parabolic trace with respect to closing pressure. The parabolic property of these paths is a result of the movement of the valve stem and the pressure drop across the valve orifice as the valve opens. If a valve is set to open at a low pressure, the pressure drop across the valve orifice is small. As the set pressure for the given valve to open increases, the pressure drop across the valve orifice increases. The trend is not linear because a path described over a large range of pressures as illustrated in FIG. 10, must follow the nonlinearity of bellows or spring compression as the valve begins to open. It is well known that springs and bellows compress at a non-linear rate.

Figure 11:
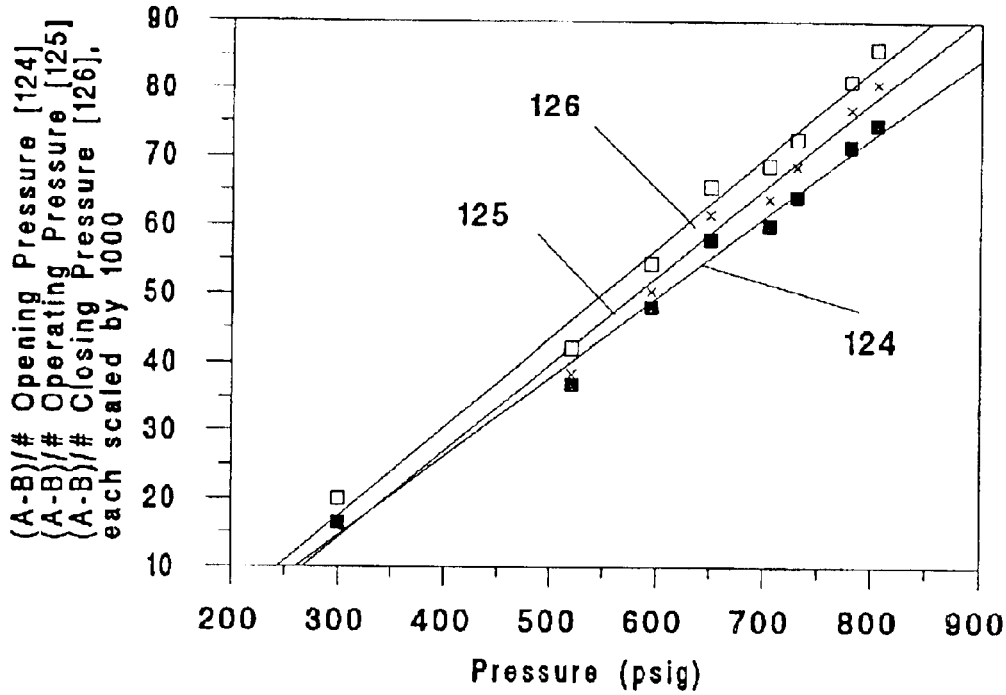
FIG. 11 shows graphs of DRLR data that describe a measure of pressure change per pound opening pressure, operating pressure, and closing pressure, scaled by 1000 for clarity.

In FIG. 11, the valve operating points of FIG. 10, described in FIG. 9, provide DRLR ratios based upon a change of pressure, kPa (psig) per kPa (psig). Path 124 shows opening pressure minus operating pressure with respect to opening pressure [ΔP/OPEN]. Path 125 shows ΔP with respect to operating pressure [ΔP/OPER]. Path 126 shows ΔP with respect to closing pressure [ΔP/CP]. FIG. 11 illustrates incremental changes in loading of the valve at a given pressure for the eight operating points shown in FIG. 1 through FIG. 8 in English units. Interpolation can be used to define other operating points for valves set to operating pressures different from the operating points in FIG. 11. For example, each datum for the eight operating points is given by a two-tupple: [abscissa, ordinate] per kPa change of opening pressure at the operating points [6100, 0.090082], [5893, 0.087392], [5772, 0.081420], [5479, 0.078073], [4859,0.077609], [4410, 0.069887], [3824, 0.062552],and [2204, 0.061615]. FIG. 11 is shown in English units [abscissa, ordinate/1000] per pound change of opening pressure at the operating points [870, 0.074713], [840, 0.071429], [780, 0.064103], [750, 0.060000], [690, 0.057971], [625, 0.048000], [540, 0.037037], and [305, 0.016393]

FIG. 11 demonstrates a difference kPa, per kPa change (difference-psig per psig change) of the pressure load which has an expected linear trend if the loading of all valves in the string of eight gas-lift valves is consistent. If each valve in the string of eight valves meets manufacturer's specifications, any of the curves 124, 125, or 126 can be used to evaluate the valves to ensure that the string of valves will operate correctly.

The data shown in the table of FIG. 9 are also used to generate DRLR data in a conventional format of kPa per centimeter (psig per inch) of stem travel. A very simple model for valve stem travel to generate the conventional form of load rate is assumed. This model assumes a maximum stem travel for a given set pressure when the pressure traces show that the pressure drop across the valve is at a relative minimum and differential pressure is zero. Absolute errors associated with this model are not relevant when comparing the DRLR values because the model is consistent and the comparisons are relative, one valve to another. Maximum stem travel is assumed under the condition that after a valve opens and equilibrium is established, the valve bellows is compressed to its maximum permitting maximum stem travel. The objective here is to define the expected trend in DRLR values for the valve string. With a maximum stem travel of 0.504 centimeters (0.20 inches), [A]–[B] data in FIG. 9 for 0.20 inches of travel generate a decreasing DRLR sequence for FIG. 1 through FIG. 8. This DRLR sequence is [922.1 kPa/cm (325 psig/inch), 854.2 kPa/cm (300 psig/inch), 718.6 kPa/cm (250 psig/inch), 650.6 kPa/cm (225 psig/inch), 582.8 kPa/cm (200 psig/inch), 447 kPa/cm (150 psig/inch), 311.3 kPa/cm (100 psig/inch), and 107.8 kPa/cm (25 psig/inch)]. The trend is clearly a monotonically decreasing function. The subject valve under evaluation is a 2.54 centimeter (1.0 inch) IPO-GLV. These DRLR variables are based upon conventional load rate dimensions and show linearity over a large range of pressures [3824 kPa to 6100 kPa (540 psig to 870 psig)]. This 2276 kPa (330 psig) range is adequate for many gas-lift valve lifting systems. It is noteworthy that the linearity of the DRLR values with respect to pressure shows that individual valves will demonstrate loading in a dynamic state without the requirement to disassemble a valve in order to determine loading by measuring stem travel. The assumption associated with the example DRLR data is full 0.504 centimeter (0.20 inch) stem travel when a valve reaches equilibrium, based upon its set opening pressure. This is a reasonable assumption. Moreover, any number can be used for the maximum stem travel because the objective of the comparison is to determine relative relationships, not absolute relationships. Absolute relationships can be determined if the true valve stem travel is used in the DRLR variables.

The linear trend over a small range of pressures suggests that all IPO-GLVs of the same type, that is 1.5875 centimeter (0.625 inch), 2.54 centimeter (1.0 inch), or 3.81 centimeter (1.5 inch) IPO-GLVs, either wireline retrievable or tubing retrievable valves, in a string of valves will follow a monotonically decreasing DRLR curve the as individual valve opening pressures are decreased. A similar conclusion holds for PPO-GLVs.

Figure 12:
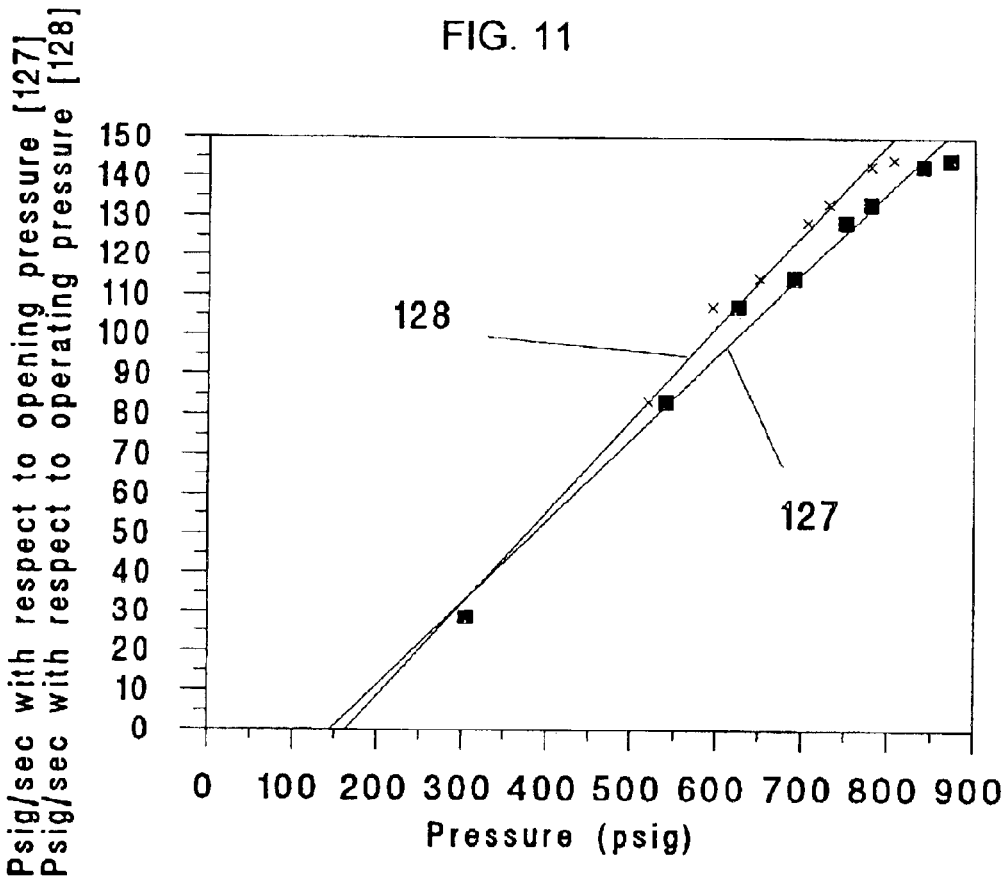
FIG. 12 shows graphs of time dependent DRLR data that describe a change in pressure with respect to a change in time as individual gas-lift valves change state from the threshold of opening pressure to the threshold of operating pressure.

FIG. 12 shows a graph of DRLR data based upon a change in pressure as the state of each individual valve in a valve string changes from a threshold opening to a threshold operating pressure [alternatively, pressure equilibrium]. The reference for the string of valves is a single valve operating at different pressures with data shown in FIG. 9. Path 127 shows ΔP per second with respect to opening pressure [OPEN]. Path 128 shows ΔP per second with respect to operating pressure [OPER]. Magnifying the region between the time a gas-lift valve opens and the time the valve reaches operating equilibrium in a closed-to-the-atmosphere environment generates the accuracy needed to show that DRLR variables can be based upon time dependency. The magnified regions [not shown] show the change-of-state time duration from opening to operating conditions. The incremental time durations are given in two-tupples [ΔP, Δt] referenced to column [A]–[B] of FIG. 9. The two-tupples are [549.5 kPa (65 psig), 0.45 seconds], [515 kPa (60 psig), 0.42 seconds], [446.1 kPa (50 psig), 0.375 seconds], [411.6 kPa (45 psig), 0.35 seconds], [377.1 kPa (40 psig), 0.31 seconds], [308.2 kPa (30 psig), 0.28 seconds], [239.2 kPa (20 psig), 0.24 seconds], and [135.8 kPa (5 psig), 0.175 seconds]. These two-tupples generate pressure-time-rate DRLR variables [ΔP/Δt] that further show the generalized monotonicity in loading of gas-lift valve strings. FIG. 12 shows time dependent DRLR variables for an equivalent string of gas-lift valves. For example, the data in FIG. 12 referenced to eight individual gas-lift valve operating pressures are [5651.6 kPa, 1096.9 kPa/sec. (805 psig, 144.4 psig/sec.)], [5479.2 kPa, 1085.9 kPa/sec. (780 psig, 142.8 psig/sec.)], [5134.5 kPa, 1018.3 kPa/sec. (730 psig, 133.3 psig/sec.)], [4962.1 kPa, 988 kPa/sec. (705 psig, 128.6 psig/sec.)], [4582.9 kPa, 889.4 kPa/sec. (650 psig, 114.3 psig/sec.)], [4203.7 kPa, 839.8 kPa/sec. (595 psig, 107.1 psig/sec.)], [3686.6 kPa, 675.7 kPa/sec. (520 psig, 83.3 psig/sec.)], and [2169.7 kPa, 298.5 kPa/sec. (300 psig, 28.6 psig/sec.)].

These data in FIG. 12 demonstrate that time dependent DRLR variables for a string of gas-lift valves, evaluated by closed-to-the-atmosphere tests, will be monotonically decreasing functions of decreasing opening and operating pressures.

Establishing monotonically decreasing [or increasing] DRLR values as valve characteristic pressures decrease [or increase] is an important conclusion. The monotonicity factor has a profound influence on the efficiency of a valve string that is lifting fluids in a hydrocarbon well. If an operating property of one valve is out of place relative to the others in the string, the production of fluids will be sub-optimal. The cost of operating a lifting program with non-monotonic DRLR values will increase.

An example of a string of seven gas-lift valves with non-monotonic character is discussed here in terms of English units. The following DRLR values are derived from a string of seven TR-IPO-GLVs removed from a producing well. Set pressures are stamped on the valves to specify the operating pressure for the valve. Following the method to generate DRLR variables in the conventional load rate format, the data are not monotonic and show variations that require excessive upstream drive pressure to keep the valves operating. Opening set pressures for seven valves [graphs not shown] are expected to be 6100, 6169, 6238, 6307, 6376, 6444, and 6513 kPa (870, 880, 890, 900, 910, 920, and 930 psig), with English units stamped into the gas-lift valve housing, Measured opening pressure data for these seven valves are 6479, 6824, 6444, 7168, 6824, 7341, and 6814 kPa (925, 975, 920, 1025, 975, 1050, and 975 psig). Measured operating pressure data are 6100, 6169, 6134, 6410, 6307, 6824, and 6444 kPa (870, 880, 875, 915, 900, 975, and 920 psig), respectively. DRLR values are generated for these seven valves by assuming 0.508 centimeter (0.200 inch) maximum stem travel and equivalent [A]–[B] terms [480, 756, 412, 860, 618, 618, and 480 kPa (55, 95, 45, 110, 75, 75, and 55 psig)] with the dimensional conversion referenced to ΔP in psig. The DRLR values are derived from individual valve graphs [not shown] to generate data similar to that shown in FIG. 9. After computing DRLR values for each valve, the following DRLR sequence is obtained: [786 kPa/cm (275 psig/inch), 1329 kPa/cm (475 psig/inch), 651 kPa/cm (225 psig/inch), 1533 kPa/cm (550 psig/inch), 1058 kPa/cm (375 psig/inch), 1058 kPa/cm (375 psig/inch), and 786 kPa/cm (275 psig/inch)]. This sequence clearly is not monotonically decreasing or increasing. The sequence shows problems with bellows, set pressures, and undesirable friction forces among the valves.

The seven valves have DRLR values from 786 kPa/cm to 1533 kPa/cm (275 psig/inch to 550 psig/inch) and show considerable scatter and lack of monotonicity. Expecting a range of DRLR values based on the 515 kPa (60 psig) range of opening pressures, DRLR values for 0.504 centimeter (0.200 inch) stem travel should be bounded by 1022 kPa/centimeter (300 psig/inch). The data show that the seven gas-lift valves have a DRLR range of 2028 kPa/centimeter (1375 psig/inch). This example illustrates how knowledge of the trend in set points and monotonically changing values of DRLR variables determine if individual valves in a string of gas-lift valves will function correctly, relative to one another.

Figure 13:
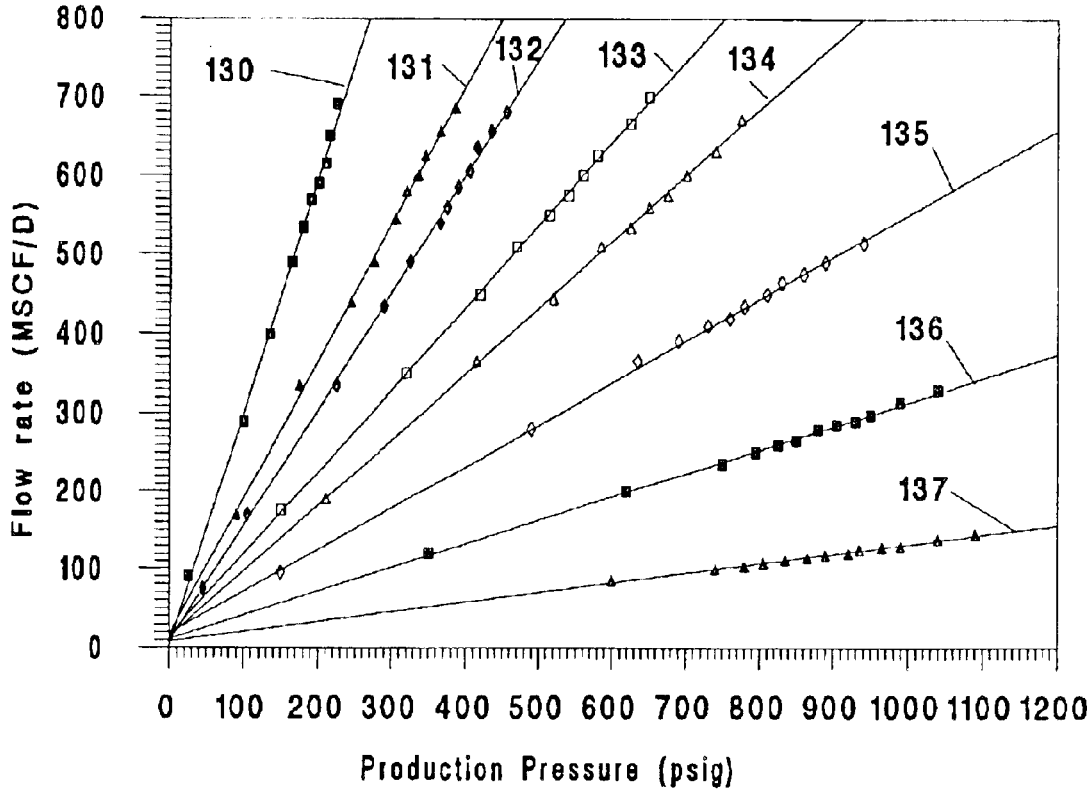
FIG. 13 shows transverse lines, alternatively fluid conductance lines, for a tested gas-lift valve, which lines are generated from pressure and flow rate data acquired at different levels of back pressure on the valve in an open-to-the-atmosphere and partly-open-to-the-atmosphere test environment.
Figure 14:
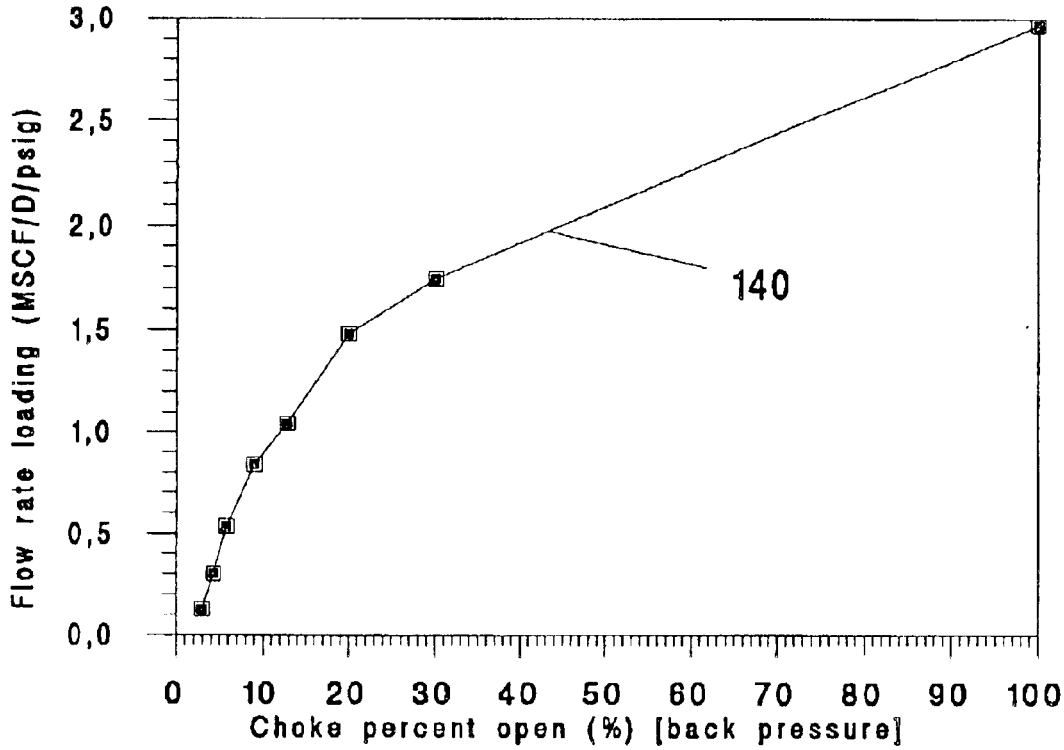
FIG. 14 shows a graph of monotonically decreasing [or increasing] flow rate loading caused by back pressure on gas-lift valves.

The idea of a load rate for fluid control devices inherently suggests a sensitivity measure. Current Art uses only a load, rate measure defined in dimensions of kPa/centimeter (psig/inch) and which Art is based upon the motion of a valve component such as a valve stem. This approach to a definition of the loading of a fluid component, especially gas-lift valve components operating at high pressures and high flow rates, is largely dependent upon conventional methods of acquiring flow rate data. FEPTS equipment and methods provide fast and accurate ways to acquire loading data that permit identifying loading characteristics for fluid control devices that were not previously available to industry because of cost and inadequate equipment. FIG. 13 and FIG. 14 show how the loading of a fluid control device, such as a gas-lift valve, can be described in terms of sensitivity to back pressure on the valve. As a result, information directly related to fluid conductivity, developed as a function of back pressure, can be used to evaluate how one valve will operate with respect to another valve in a string of valves.

FIG. 13 shows transverse line, alternatively fluid conductance line, data for a WR-IPO-GLV as described by the FEPTS. The data in FIG. 13 are generated from a single gas-lift valve pre-set to operate at 5,617.1 kPa (800 psig) at 15.56 degrees Celsius (60 degrees Fahrenheit). Data are shown in eight transverse lines corresponding to eight levels of back pressure on the valve for drive pressures up to 7685 kPa (1100 psig). Line 130 identifies data for a choke valve downstream of the tested gas-lift valve that is 100 percent open. Line 131 identifies data for a downstream choke valve 30.1 percent open. Line 132 identifies data for a downstream choke valve 20.0 percent open. Line 133 identifies data for a downstream choke valve 12.9 percent open. Line 134 identifies data for a downstream choke valve 9.0 percent open. Line 135 identifies data for a downstream choke valve 5.9 percent open. Line 136 identifies data for a downstream choke valve 3.9 percent open. Line 137 identifies data for a downstream choke valve 2.9 percent open. These characteristic lines have the dimensions of fluid conductivity, MSCM/D/kPa (MSCF/D/psig). FIG. 13 is based upon a single gas-lift valve, but demonstrates how individual gas-lift valves in a string of gas-lift valves will generate equivalent data.

FIG. 13 and FIG. 14 show that as back pressure increases, a valve becomes more heavily loaded and flow rate decreases. In practical gas-lift valve string installations, back pressure increases as depth of fluid increases under producing-well conditions or under unloading-well conditions. FIG. 13 and FIG. 14 also suggest an alternative method for designing a string of gas-lift valves, described as follows:

[1] set each gas-lift valve in a string of valves to one operating point; and,

[2] use a downstream choke valve in conjunction with expected fluid back pressure, or include a fixed or variable choke valve internal to each gas-lift valve, to establish a required fluid flow rate.

FIG. 14 shows that individual gas-lift valves in a string of gas-lift valves will conform to a monotonically decreasing [or increasing] function of back pressure. Characteristic flow rate load curve 140 is based upon flow rate loading MSCM/D/kPa (MSCF/D/psig) and plotted as a function of downstream choke percent open [back pressure]. Individual gas-lift valves that are used in a string of gas-lift valves when set to the same or to different operating pressures will follow a characteristic flow rate load curve similar to curve 140 and be monotonically decreasing [or increasing] with respect to back pressure on the individual valves.

When comparing and contrasting the relative operation of individual gas-lift valves in a valve string, a non-linear characteristic flow rate loading curve, as shown in FIG. 14, may have lesser or greater curvature, depending upon pre-set valve operating pressures. The monotonicity of DRLR curves associated with flow rate loading are present for all downstream choke valve conditions, even when no choke valves are used, a condition representing 100 percent valve open in a configuration in which valve operating pressures are set by the conventional practice of higher operating pressure for gas-lift valves operating deeper in a well.

The DRLR For Fluid Systems methods, establishes DRLR operating characteristics for individual gas-lift valves in a string of valves designed to lift hydrocarbons from a single hydrocarbon well, which methods are transferrable to establish DRLR operating characteristics for individual wells in a hydrocarbon well-field. When hydrocarbons well-fields are operated under gas-lift, a gas compressor is usually required to supply lifting-fluid to each well. Production economics depend upon the cost of supplying lifting-fluid to each well-head at lifting-design pressures and upon the amount of economic fluid produced by the well operated under gas-lift. With current Art, lifting-fluid supply is commonly over designed because of a lack of dynamic relative load rate information about how each well loads compressor (s), relative to the well's hydrocarbon production, with respect to other wells in the field.

The application of DRLR methods to well-fields requires selecting a reference gas-lift valve for each string of valves, as described in the discussion of FIG. 10, and using this selected group of reference valves, one for each well, to define relative loading by the approach described for FIG. 10, FIG. 11, FIG. 12, and FIG. 14, as applicable. In the preferred embodiment, the reference gas-lift valve for multiple well loadings is a principal producing valve for each well.

The application of DRLR methods to well-fields provides a new way to optimize hydrocarbon lifting systems by ensuring that each gas-lift valve in the well-field operates according to the design of individual valve-string sub-systems, and each valve-string sub-system will operate according to design specifications for the entire field of wells.

The methods of formulating dynamic relative load rates from the DRLR For Fluid Systems invention are described with reference to a preferred embodiment. Others skilled in the technology of fluid pressure and fluid flow rate measurement, and the design of gas-lift valve well-fields will be able to make various modifications of the described embodiment without departing from the spirit and scope of the invention of DRLR For Fluid Systems. It is intended that all elements and steps that perform substantially the same function in substantially the same way to achieve substantially the same results are within the scope of the invention of Dynamic Relative Load Rate For Fluid Systems.

I claim:

1. A method for defining, calculating, and evaluating various dynamic relative load rate [DRLR] variables for sets of fluid control devices operating as a fluid system with dimensions of said DRLR variables including, but not limited to a dynamic kPa/cm (psi/inch), kPa/second (psi/second), kPa/unit kPa (psi/unit psi), and MSCM/D/unit kPa (MSCF/D/unit psi), and with said fluid control devices including, but not limited to gas-lift valves that operate in strings of said valves to lift hydrocarbons from onshore and offshore reservoirs with the values of said DRLR variables to be derived from test data, including but not limited to fluid pressure, fluid flow rate, temperature, and time data and static mechanical distance data, including maximum distance of travel of a valve stem, with said test data generated by test equipment and associated fluid energy pulse tests of each member of the set, and which DRLR variable definition permits any fluid control device in the set to be selected as a reference device for comparison when evaluating the loading characteristics associated with the operation of all fluid control devices in the set, and whereby the value of each DRLR variable is determined from one or more characteristics of dynamic test data and static mechanical distance data for each fluid control device, said method comprising the steps:

(a) acquiring test data as a function of time for one fluid control device using one or more slowly increasing positive or slowly decreasing negative energy pulses, or one or more explosively increasing positive or explosively decreasing negative energy pulses;

(b) repeating step (a) for each fluid control device in the set of fluid control devices under evaluation, in which each fluid control device is set to operate at a specific temperature, a fluid upstream pressure, and a fluid downstream pressure, with a specific fluid flow rate;

(c) selecting one or more characteristics from a set of characteristics of test data acquired in step (a) and step (b), with each selected characteristic providing a dynamic event or dynamic property of fluid pressure, fluid flow rate, temperature, and/or time for each fluid control device under evaluation, said characteristics to be used to create a DRLR variable that is common to each fluid control device;

(d) selecting the dimensions for a DRLR variable from the characteristics selected in step (c) in order to assign a value to the DRLR variable for each fluid control device in the set, with said dimensions based upon combinations of static and/or dynamic variables, and which dimensions may include static approximations;

(e) designating one fluid control device as a reference fluid control device and establishing the value of the DRLR variable for said reference fluid control device from test data that satisfy the dimensions selected in step (d), whereby a value of the DRLR variable for the reference device and values for all other DRLR variables for the fluid control devices in the set are enumerated as DRLR data in terms, not limited to, but including, kPa/unit kPa (psi/unit psi), kPa/second (psi/second), MSCM/D/unit kPa (MSCF/D/unit psi), and kPa/centimeter (psi/inch);

(f) plotting the values of DRLR variables enumerated as DRLR data in step (e) on a DRLR graph of the DRLR variable with respect to fluid pressure, to fluid flow rate, to time, or to a mechanical dimension associated with the generation of energy pulses for each fluid control device, said mechanical dimension including a percent open state of a set-valve that generates back pressures on the fluid control devices;

(g) identifying the characteristic curve of the DRLR data plotted in step (f) for all of the fluid control devices under evaluation, which curve may be of any configuration, depending upon the dimensions selected in step (d), but which curve generally follows a monotonically increasing or a monotonically decreasing path of the DRLR variable;

(h) defining error-bounds for the curve identified in step (g), with said error-bounds providing limits on the variation of the values of the DRLR variables plotted in step (f); and, (i) comparing the DRLR values plotted in step (f) and/or the DRLR curve of step (g to the value of the DRLR variable for the reference fluid control device designated in step (e) and to the error-bounds defined in step (h), to ensure that all DRLR data show a well-defined dynamic operating relationship with respect to the reference fluid control device and that all DRLR data fall within said error-bounds, thereby ensuring an acceptable dynamic relative load rate characteristic for all fluid control devices in the set.

2. The method of claim 1 in which the fluid energy to generate test data for the fluid control devices under evaluation is delivered in test equipment by one or more energy pulses in slow motion or in explosive motion and which energy pulses are impulse, step, ramp, or frequency functions of increasing and decreasing fluid pressure and fluid flow rate.

3. The method of claim 2 in which energy pulses are delivered in test equipment that is configured open-to-the-atmosphere, with maximum fluid release to the atmosphere, partly-open-to-the-atmosphere, with less than maximum fluid release to the atmosphere, or closed-to the-atmosphere, with no fluid release to the atmosphere, or combinations thereof.

4. The method of claim 1 in which one or more characteristics of test data, including opening, operating, and closing pressures, are identified at one or more times, one or more pressures, one or more flow rates, one or more temperatures, or at one or more mechanical distances, or at combinations thereof for each fluid control device in the set under evaluation.

5. The method of claim 1 in which multiple tests of different fluid control devices, or of the same fluid control device, can be made to be identical in terms of the test protocol, the thermodynamic properties of the test fluid, the energy pulse or pulses generated, the test equipment configuration, and the initial test conditions.

6. The method of claim 1 in which test equipment to generate test data has a capability to produce fluid energy pulses, to acquire, to store, to perform mathematical operations on, and to print said test data.

7. The method of claim 1 in which test data, from which DRLR variables and DRLR data are defined, are acquired by automatic data collecting equipment with amplitude accuracy of 1.0 percent or less of measured value and sampling time, of 0.010 seconds or less to capture variations of said test data for each fluid control device in the set under evaluation.

8. The method of claim 1 in which test data include opening pressure, closing pressure, upstream pressure, downstream pressure, differential pressure, operating pressure, fluid flow rate, fluid-supply reservoir pressures, relative maximum pressure events, relative minimum pressure events, pressure event anomalies, and mechanical distance measurements associated with the test of a fluid control device in the set of devices under evaluation.

9. The method of claim 1 in which DRLR data are stored in an electronic storage medium, so that said DRLR data can be used to evaluate a set of fluid control devices at a specific location, or said DRLR data can be sent by a transmission means to a remote location to evaluate the set of fluid control devices.

10. The method of claim 1, applied to a set of gas-lift valves in a fluid lifting string, in which DRLR data for each gas-lift valve follow a curve that has a monotonically decreasing or monotonically increasing characteristic with respect to fluid pressure, to fluid flow rate, or to a mechanical measure associated with the gas-lift valves in the set.

11. The method of claim 1 in which a DRLR variable is created from a ratio defined by a numerator and a denominator, each of which is constructed from a mathematical combination of static mechanical data and/or fluid-dynamic test data, which data represent operating characteristics of the members of the set of fluid control devices under evaluation, and in which either the numerator or the denominator includes a dimension of fluid pressure, fluid flow rate, or fluid temperature.

12. The method of claim 1 in which the DRLR variable that is common to all fluid control devices in the set of fluid control devices under evaluation is selected by combining variables with one or more dimensions of mass [M], length [L], and/or time [T], or by combining variables that are derived from MLT, said derivatives including but not limited to, force, torque, pressure, flow rate, acceleration, volume, weight, velocity, and rate of change of mass, length, or time.

13. The method of claim 1 in which test data for a fluid control device in the set under evaluation are generated by test equipment configured open-to-the-atmosphere, said test data including downstream fluid pressure or back-pressure, upstream fluid pressure, and fluid flow rate, which pressures and flow rate collectively determine fluid conductivity through, or alternatively, fluid resistance of, each device under evaluation, and whereby a DRLR variable is defined to measure dynamic relative loading from back pressure on and fluid conductivity through one fluid control device with respect to other fluid control devices in the set.

14. The method of claim 13 in which a means to generate back pressures on and to control fluid flow rate through a fluid control device in the set under evaluation is a valve that chokes fluid flow downstream of each said fluid control device.

15. The method of claim 1 in which a DRLR graph of relative fluid loading for all fluid control devices in the set under evaluation is defined by an ordinate variable with dimensions of the DRLR variable common to all members of the set, or alternatively, b an ordinate that is normalized dimensionless with respect to the reference fluid control device, and by an abscissa variable that reflects pressure, flow rate, or mechanical distance associated with the tests of fluid control devices under evaluation, in which selecting the ordinate variable comprises the steps:

(a) selecting a denominator for the common DRLR variable to be either a constant value or a variable derived from test data;

(b) formulating one mathematical expression for the denominator of the DRLR variable by addition, subtraction, multiplication, or division, or a combination thereof;

(c) selecting a numerator for the common DRLR variable to be a variable derived from test data;

(d) formulating one mathematical expression for the numerator of the DRLR variable by addition, subtraction, multiplication, or division, or a combination thereof;

(e) defining the ordinate variable of the DRLR graph by combining the denominator formulated in step (b) with the numerator formulated in step (d); and, (f) establishing a DRLR value for each DRLR variable from test data generated by energy pulse tests of each fluid control devices under evaluation and specifying the ordinate by at least the maximum value of all DRLR variables in the set; or, alternatively;

(g) normalizing the DRLR graph by specifying a reference fluid control device; and, (h) defining the normalized ordinate of the DRLR graph by at least the maximum value of the normalized values of all DRLR variables in the set with respect to the value of the DRLR variable of the reference fluid control device in step (g) by dividing said reference DRLR variable by each DRLR variable of the remaining members in the set.

16. The method of claim 1 in which a value of the DRLR variable that is common to each gas-lift valve in a string is determined for any operating pressure within a range of the manufacturer's minimum to maximum operating pressure for each gas-lift valve in the string.

17. The method of claim 1 to identify a failing or faulty fluid control device that may have passed all manufacturer's tests for operation with respect to said manufacturer's specifications, but which fluid control device does not operate in a pre-defined, or expected, dynamic relative relationship, with respect to other fluid control devices within a fluid system under evaluation, by defining error-bounds on the value of the DRLR variable for each said fluid control device and by defining acceptable DRLR graph characteristics for all fluid control devices in said fluid system.

18. A method to design a fluid lifting system using DRLR variables for gas-lift valves comprising the following steps:

(a) setting each gas-lift valve in a valve string to a specific operating set point;

(b) choking the inlet fluid or the outlet fluid with an appropriate choke valve to generate a system design flow rate, which flow rate is dependent upon the pressure loading generated by one or more choke valves, such that one said choke valve may be internal to, and comprise part of said gas-lift valve, or one said choke valve may be external to said gas-lift valve; and, (c) comparing and contrasting the DRLR variables describing relative operation of individual gas-lift valves in a string of choked gas-lift valves to a reference valve in the string, and with choked flow rates generating pressure or flow rate load on each individual valve equivalent to the downhole conditions into which the string of valves will be placed.

19. A DRLR criterion, based upon a DRLR variable that is formulated to be common to each gas-lift valve in a string of gas-lift valves under evaluation, with said common DRLR variable comprising one or more variables of gas-lift valve opening pressure, operating pressure, closing pressure, relative maximum pressure event, relative minimum pressure event, fluid flow rate, temperature, time duration, and/or an arbitrary length of valve stem travel, wherein the DRLR variable identifies a dynamic operating characteristic of each gas-lift valve in the string; the value of the DRLR variable for each gas-lift valve is plotted to show the operation of one gas-lift valve in a relative position with respect to other gas-lift valves in the string; and, the DRLR formulation permits combinations of dimensions, with said DRLR criterion incorporating relative values into DRLR variables, including an arbitrary constant stem travel to a fully open state for each gas-lift valve in the string, without requiring a mechanical measurement of absolute stem travel.

20. A method to design a fluid pressure and fluid flow rate hydrocarbon-lifting system with DRLR variables for a plurality of hydrocarbon wells in a hydrocarbon well-field, each said well containing a plurality of gas-lift valves, comprising the steps:

(a) identifying a reference gas-lift valve for each hydrocarbon well in said well-field;

(b) formulating a single, identical DRLR variable for each reference gas-lift valve identified in step (a), with said DRLR variable based upon fluid pressure, fluid flow rate, temperature, and/or time data, or combinations thereof, and which DRLR variable captures at least one dynamic operating characteristic of each gas-lift valve identified in step (a);

(c) enumerating and plotting the DRLR variable formulated in step (b) for each reference gas-lift valve identified in step (a) with respect to fluid pressure or fluid flow rate;

(d) selecting a maximum pressure and a maximum flow rate to be delivered by a fluid supply compressor or reservoir for each reference gas-lift valve identified in step (a);

(e) specifying the degree of choking of fluid flow rate required for each reference gas-lift valve enumerated and plotted in step (c) from the fluid supply compressor or fluid supply reservoir selected in step (d): and, (f) specifying the capacity of a fluid supply compressor and/or fluid reservoir for the well-field; whereby the lifting of hydrocarbons from individual wells in a well-field is optimized with respect to projected installation and operating costs, before installing compressors, piping, and gas-lift valves for each hydrocarbon well thereby improving the economic benefit from hydrocarbon-lifting installations.

* * * * *